United States Patent [19]

Rivkin

[11] 4,435,028

[45] Mar. 6, 1984

[54] HINGED CONTAINER FOR RELAY RACKS

[75] Inventor: Eric M. Rivkin, Minnetonka, Minn.

[73] Assignee: Liberty Carton Co., Minneapolis, Minn.

[21] Appl. No.: 241,575

[22] Filed: Mar. 9, 1981

[51] Int. Cl.[3] ..... A47B 43/00; A47G 19/08

[52] U.S. Cl. ..... 312/258; 312/111; 220/7; 217/43 A; 211/41

[58] Field of Search ..... 312/258, 259, 140.2, 312/140.4, 265, 111; 108/41, 60, 61, 111, 112; 16/389; 206/600; 220/7; 217/43 A; 248/678, 346; 211/41

[56] References Cited

U.S. PATENT DOCUMENTS

| | | | |
|---|---|---|---|
| 1,230,830 | 6/1917 | Ickes | 220/7 |
| 2,121,225 | 6/1938 | Ghrist | 211/41 |
| 2,291,888 | 8/1942 | Ericksen et al. | 220/7 |
| 2,475,513 | 7/1949 | Peckinpaugh | 312/258 |
| 2,738,058 | 3/1956 | Hansen et al. | 217/43 A |
| 2,764,462 | 9/1956 | McDonald | 312/140.2 |
| 3,765,556 | 10/1973 | Baer | 220/7 |
| 3,838,777 | 10/1974 | Thornicroft et al. | 211/41 |
| 4,023,871 | 5/1977 | Dantzler | 312/108 |
| 4,099,809 | 7/1978 | Leotta | 312/258 |
| 4,236,460 | 12/1980 | Poupko | 312/258 |
| 4,240,359 | 12/1980 | Howe | 220/7 |
| 4,277,120 | 7/1981 | Drake et al. | 312/111 |

FOREIGN PATENT DOCUMENTS

| | | | |
|---|---|---|---|
| 255323 | 9/1962 | Australia | 217/43 A |
| 2051841 | 4/1972 | Fed. Rep. of Germany | 248/346 |
| 532788 | 1/1941 | United Kingdom | 16/389 |

*Primary Examiner*—Victor N. Sakran

*Attorney, Agent, or Firm*—Williamson, Bains, Moore & Hansen

[57] ABSTRACT

A shipping container for relay racks has a platform base with pallet skids beneath. Two end panels are hingedly attached to opposite ends of the platform and extend upwardly. The end panels are attached to the ends of the relay rack by means of toggle bolts. The hinged construction allows the device to be easily folded for return shipping and also provides substantial protection against forklift puncture.

3 Claims, 9 Drawing Figures

HINGED CONTAINER FOR RELAY RACKS

BACKGROUND OF THE INVENTION

In providing a shipping container for relay racks, it is important to have a container which snugly locates and secures the rack while at the same time providing a container which is easily assembled and which may be easily knocked down and reused when desired. Prior efforts have consisted of a platform-like member having end plates which bolt to the platform and which end plates and platform have spaced blocks attached thereto which effectively form a slot for holding the bay frame of the relay rack. Such prior efforts have proven to be relatively difficult to assemble and disassemble as well as being somewhat lacking in strength.

SUMMARY OF THE INVENTION

A platform member is provided with two or three skids on the bottom thereof to accommodate the use of a forklift truck in picking up the platform, the skids acting to provide a pallet-like assembly. A pair of hinged end panels are provided at either end of the platform assembly, the hinge assembly having an L-shaped fixed member fastened to the platform. This L-shaped hinge member provides a substantial amount of strength to the platform since it extends completely across the end. The hinge member also extends upwardly from the platform a distance sufficient to provide a substantial degree of puncture resistance against the forks of a forklift should the operator of the forklift misjudge the height of the pallet assembly. The hinged end panels are secured to the ends of the bay frame by means of toggle bolts. This additional degree of securement not present in the prior art provides an added degree of structural integrity to the package lacking in prior art efforts. Securing blocks similar to those in the prior art are located on both the platform and on the inner surfaces of the end panels to provide further lateral securement of the relay rack. A center C-frame is provided having one or more notched bracing blocks attached thereto for retention of the upper end of the rack. It can be appreciated that while reference is made specifically herein to relay racks, it is apparent that the invention is suitable for packaging other types of devices having metal frames which may be used to lend a degree of structural integrity to the package. The use of the term, relay rack, is thus intended to refer to all such devices.

These and other objects and advantages of the invention will become readily apparent as the following description is read in conjunction with the accompanying drawings wherein like reference numerals are used to refer to the views.

BRIEF DESCRIPTION OF THE DRAWING FIGURES

DESCRIPTION OF THE PREFERRED EMBODIMENT

Figure 8:
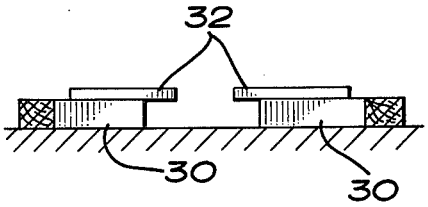
FIG. 8 is a sectional view taken along line 8—8 of FIG. 1 showing an alternate embodiment.
Figure 3:
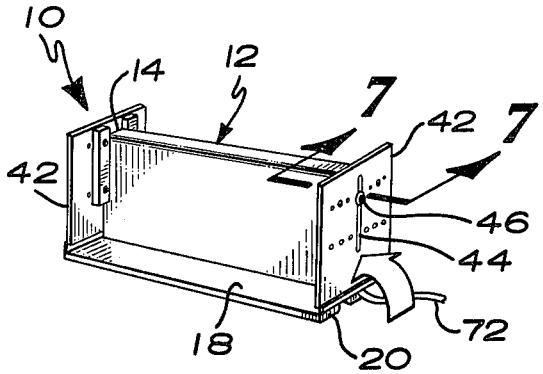
FIG. 3 is a perspective view at one stage of assembly.

The hinged container for relay racks, generally 10, is designed for use with relay racks 12 having an end panel 14 thereon. Relay racks 12 generally have a rectangular shape and are constructed with a metal frame. Container 10 is formed around a base assembly 16 which is comprised in particular of a platform member 18 made of plywood or the like. Platform 18 has a plurality of skids 20 attached therebeneath to form, in effect, a pallet assembly by which a forklift may be used to lift the container 10. Base 16 has first and second ends 22 and 24 respectively and first and second sides 26 and 28 respectively. Pairs of bracing blocks 30 are attached by nailing or the like to platform member 18 and are spaced apart a distance sufficient to accommodate the largest frames which may be utilized. As shown in FIG. 8, auxiliary bracing blocks 32 may be nailed on top of bracing blocks 30 with a lesser spacing therebetween in order to accommodate a narrower frame.

Figure 2:
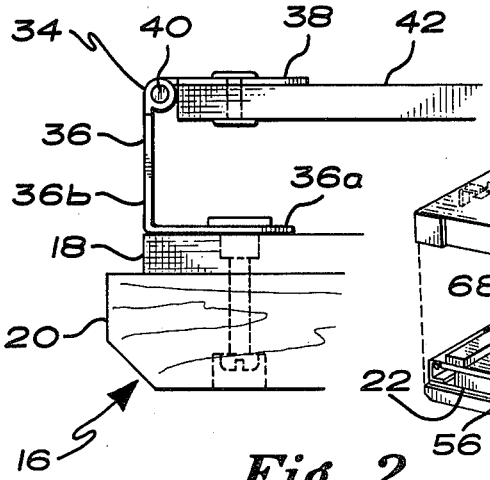
FIG. 2 is a side view of the hinge in the folder position.

Hinge assemblies 34 are located at first and second ends 22 and 24 of base assembly 16. Hinge assemblies 34 extend substantially the width of platform 16 and are bolted to each of the runners 20 thereby adding substantial strength to the assembly. Each hinge assembly 34 is comprised of a base portion 36 and a side portion 38 as shown in detail in FIG. 2. Base portion 36 is comprised of a horizontal panel **36*a* and a vertical panel 36*b* normal to horizontal panel 36*a*. Actual joint 40 of hinge assembly 34 joins hinge side portion 38 to hinge base portion 36. It is to be noted that the combination of hinge panel 36*b* and side portion 38 constitute a substantial reinforcement against inadvertent puncture by a forklift operator misjudging the height of platform 18. Hinge side portion 38 is affixed to end panels 42** by means of bolts, screws or the like.

Figure 1:
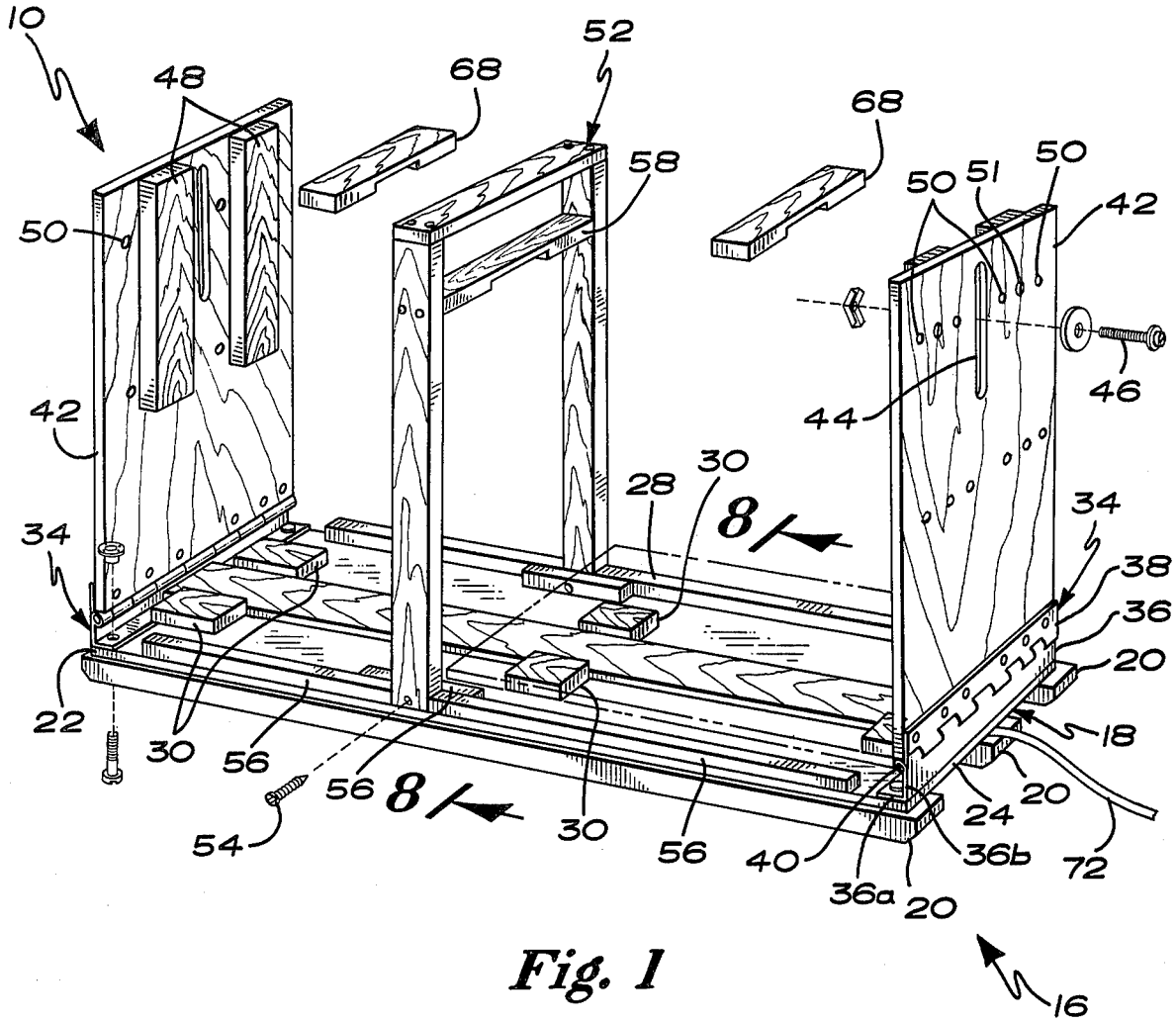
FIG. 1 is a perspective view of the invention with some parts exploded.
Figure 7:
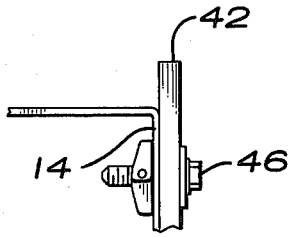
FIG. 7 is a sectional view taken along line 7—7 of FIG. 3.

End panels 42 are rectangular in shape and also formed of plywood or the like. End panels 42 have located near the top thereof vertical slots 44. Slots 44 accommodate toggle bolt assemblies 46 which are conventional in type and which are used to secure end panels 42 to frame end panels 14 as shown particularly in FIG. 7. The attachment of end panels 42 by means of toggle bolts 46 serve to cause the frame 12 to become part of the structure of the package 10, thus further strengthening the device.

End bracing blocks 48 are attached to end panels 44 for lateral restraint of frame 12. Attachment is by way of bolts 51 inserted through one of the sets of holes 50. As shown in the drawings, holes 50 are provided in varying spacing so as to allow different width frames 12 to be utilized. Alternatively, bracing block adopters 32 such as shown in FIG. 8 may be utilized to accommodate a narrow frame 12.

Figure 4:
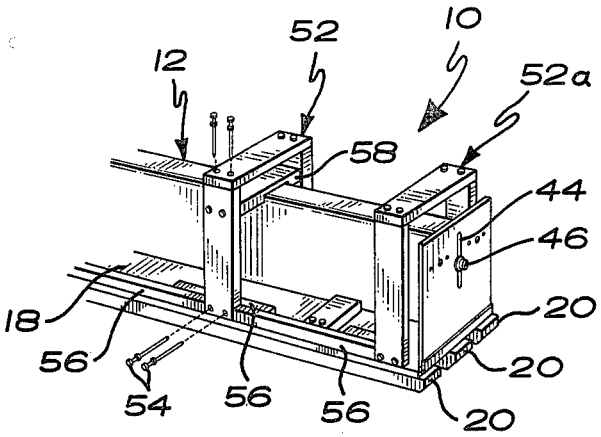
FIG. 4 is a further perspective view at one stage of assembly.

A center C-frame 52 is attached to platform 18 by means of bolt or screw 54 and stringers 56 as shown in FIG. 4. Stringers 56 also serve to provide a surface onto which a cover may be attached as described more fully hereinafter. A notched bracing block 58 is nailed to center C-frame 52 for vertical and lateral restraint of frame 12.

While the apparatus shown in the accompanying drawings is generally intended for use with frames 12 having a height shorter than end panels 42, frames 12 taller than end panels 42 may be accommodated by the use of additional C-frames 52*a* as shown in FIG. 4. Additional C-frames 52*a* serve to support the cover at the ends thereof, the application of the cover to both versions being described hereinafter.

Figure 5:
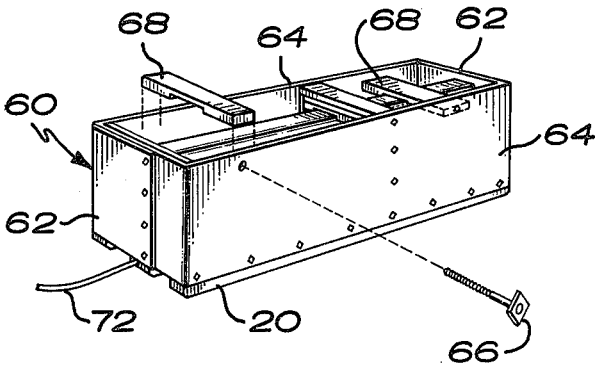
FIG. 5 is a further perspective view at one stage of assembly.
Figure 6:
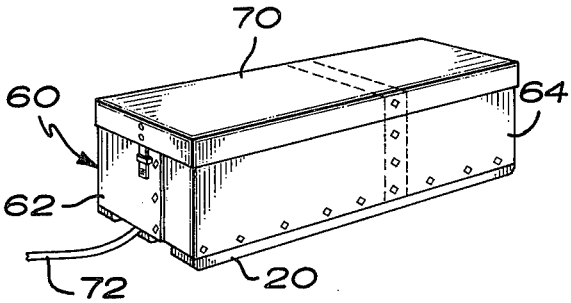
FIG. 6 is a further perspective view at one stage of assembly.

An outer sleeve 60 is tubular in nature and is comprised of two end walls 62 and two side walls 64. Sleeve 60 is attached by nails 66 as shown to skids 20 and stringers 56 as well as to C-frame 52 as shown in FIG. 5. Additional notched bracing blocks 68 are nailed to sleeve 60 to provide further vertical restraint. A box top 70 fits over sleeve 60 at the top end thereof to complete the container as shown in FIG. 6. Straps 72 may be utilized to secure cover 70 to container 10. Additionally, if desired, cover 70 may be further nailed to various portions of the device such as center C-frame 52.

Figure 9:
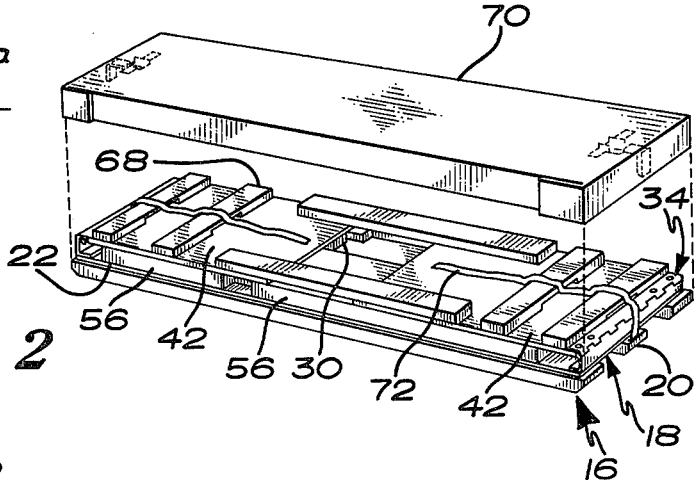
FIG. 9 is a prospective view showing the container knocked down for shipping.

For purposes of shipping, center C-frame 52 is removed by detaching fasteners 54 and end panels 42 folded down so as to be substantially parallel to base assembly 16 as shown in FIG. 9. The resulting assembly is quite compact and easily packaged for shipping. In addition to the strengthening and puncture-resistance function served by hinged assemblies 34, hinge assemblies 34 also enable container 10 to be set up and knocked down quickly without having to utilize a number of fasteners to separately attach end panels 42 to base assembly 16.

While reference has generally been made to fasteners, nails and the like, it is appreciated that various types of commonly used hardware may be used. Preferably, when nailing through cardboard such as application of sleeve 60 and cover 70, it is desirable to use nails having a substantial head or washer so as to prevent the nail from pulling through the corrugated material. When nailing one piece of wood to another, various types of nails may be used.

While the preferred embodiments of the present invention have been described, it should be understood that various changes, adaptations and modifications may be made therein without departing from the spirit of the invention and the scope of the appended claims.

What is claimed is:

1. A hinged container for a relay rack, said relay rack comprising first and second end walls, each said end wall comprising an inner surface and further comprising at least one hole therein, said container in combination with said rack comprising:

a base, said base comprising:

a platform member having first and second ends and first and second sides; and pallet means for lifting said pallet above a surface, said pallet means comprising at least one opening therein for insertion of a lifting device, each said opening extending between said ends and parallel to said sides;

a first end panel;

a second end panel, said end panels being slightly longer than said end walls;

first and second hinges, each said hinge comprising:

a hinge base portion fixedly attached to said base at one of said ends;

a hinge side portion fixedly attached to one of said end panels, said hinge side portion being hinged to said hinge base portion, and wherein said hinge base portion is L-shaped in cross-section with a horizontal panel parallel and attached to said platform member and a vertical panel, said vertical panel being hinged to said hinge side portion, said vertical panel extending substantially above said platform member; and means for securing said end panels to said rack end walls, the distance between said end panels being substantially equal to the distance between said rack end walls, said securing means cooperating with said inner surfaces and holes.

2. The hinged container for a relay rack of claim 1 wherein said securing means comprises toggle bolts.

3. The hinged container for a relay rack of claim 2 wherein said securing means further comprises at least one vertical slot in each said end panel for locating said toggle bolts.

* * * * *